US012384608B2

(12) United States Patent
Lohrman et al.

(10) Patent No.: US 12,384,608 B2
(45) Date of Patent: Aug. 12, 2025

(54) PROTRUSION ON CONTAINER NECK

(71) Applicant: Silgan White Cap LLC, Downers Grove, IL (US)

(72) Inventors: Richard D. Lohrman, Montgomery, IL (US); John D. Guio, Geneva, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 151 days.

(21) Appl. No.: 18/059,215

(22) Filed: Nov. 28, 2022

(65) Prior Publication Data

US 2023/0145263 A1 May 11, 2023

Related U.S. Application Data

(63) Continuation of application No. PCT/US2022/079390, filed on Nov. 7, 2022.

(60) Provisional application No. 63/292,266, filed on Dec. 21, 2021, provisional application No. 63/276,991, filed on Nov. 8, 2021.

(51) Int. Cl.

| | |
|---|---|
| ***B65D 1/02*** | (2006.01) |
| ***B65D 41/04*** | (2006.01) |
| ***B65D 41/34*** | (2006.01) |
| ***B65D 43/24*** | (2006.01) |
| ***B65D 55/16*** | (2006.01) |

(52) U.S. Cl.

CPC ..... *B65D 55/16* (2013.01); *B65D 1/0246* (2013.01); *B65D 41/0428* (2013.01); *B65D 41/3428* (2013.01); *B65D 43/24* (2013.01); *B65D 2251/1008* (2013.01); *B65D 2401/30* (2020.05)

(58) Field of Classification Search

CPC ..... B65D 1/023; B65D 1/0246; B65D 2251/1008; B65D 43/24

See application file for complete search history.

(56) References Cited

U.S. PATENT DOCUMENTS

| | | | |
|---|---|---|---|
| 2,990,077 | A | 6/1961 | Baarn |
| 3,441,161 | A | 4/1969 | Baarn |
| 4,394,918 | A | 7/1983 | Grussen |
| 4,557,393 | A | 12/1985 | Boik |
| 4,565,295 | A | 1/1986 | Mori et al. |
| 4,666,053 | A | 5/1987 | Corcoran et al. |
| 4,805,792 | A | 2/1989 | Lecinski, Jr. |
| 5,215,204 | A | 6/1993 | Beck et al. |
| 5,295,600 | A | 3/1994 | Kowal |

(Continued)

FOREIGN PATENT DOCUMENTS

| | | |
|---|---|---|
| CN | 1631740 | 6/2005 |
| CN | 1631741 | 6/2005 |

(Continued)

OTHER PUBLICATIONS

International Search Report and Written Opinion for International Application No. PCT/US2022/079390, dated Mar. 16, 2023, 10 pages.

(Continued)

*Primary Examiner* — Allan D Stevens

(74) *Attorney, Agent, or Firm* — Reinhart Boerner Van Deuren s.c.

(57) ABSTRACT

A protrusion on a container neck is provided. The protrusion is configured to interface with hinged, tethered closures to bias the body of the closure away from the container neck.

15 Claims, 8 Drawing Sheets

(56) References Cited

U.S. PATENT DOCUMENTS

| | | | | |
|---|---|---|---|---|
| 5,360,126 | A | 11/1994 | Snyder et al. | |
| 5,398,837 | A | 3/1995 | Degrassi | |
| 5,676,269 | A | 10/1997 | Blake et al. | |
| 5,725,115 | A | 3/1998 | Bosl et al. | |
| 5,735,418 | A | 4/1998 | Erb et al. | |
| 5,779,075 | A | 7/1998 | Salmon et al. | |
| 5,853,095 | A | 12/1998 | Marshall et al. | |
| 6,102,257 | A | 8/2000 | Goyet | |
| 6,116,443 | A | 9/2000 | Parrinello | |
| 6,372,167 | B1 | 4/2002 | Morini | |
| 6,474,491 | B1 | 11/2002 | Benoit-Gonin et al. | |
| 6,478,184 | B2 | 11/2002 | Berge et al. | |
| 6,986,434 | B1 | 1/2006 | Getsy et al. | |
| 7,314,150 | B2 | 1/2008 | Skillen | |
| D593,856 | S | 6/2009 | Kubler | |
| 7,712,618 | B2 | 5/2010 | Barre et al. | |
| D648,215 | S | 11/2011 | Rigling et al. | |
| 8,469,213 | B2 | 6/2013 | Ishii et al. | |
| 8,490,805 | B2 | 7/2013 | Giraud et al. | |
| 8,602,234 | B2 | 12/2013 | Hayashi | |
| 8,695,822 | B2 | 4/2014 | Kwon | |
| 8,720,716 | B2 | 5/2014 | Campbell | |
| 9,010,555 | B2 | 4/2015 | Luzzato et al. | |
| 9,108,774 | B2 | 8/2015 | Kwon | |
| 9,376,243 | B2 | 6/2016 | Cerveny | |
| 9,643,762 | B2 | 5/2017 | Maguire | |
| 9,776,779 | B2 | 10/2017 | Campbell | |
| 9,828,146 | B2 | 11/2017 | Maguire | |
| 9,932,159 | B2 | 4/2018 | Maguire | |
| 9,975,677 | B2 | 5/2018 | Maguire | |
| 10,138,035 | B2 | 11/2018 | Loukov | |
| 10,272,599 | B2 | 4/2019 | Cerveny | |
| 10,518,942 | B2 | 12/2019 | Seibert et al. | |
| 10,647,486 | B2 | 5/2020 | Maguire | |
| 10,654,624 | B2 | 5/2020 | Sung | |
| 10,654,625 | B2 | 5/2020 | Migas et al. | |
| 10,836,549 | B2 | 11/2020 | Maguire | |
| 10,981,700 | B2 | 4/2021 | Migas et al. | |
| 11,040,806 | B2 | 6/2021 | Naumann et al. | |
| 2003/0136783 | A1 | 7/2003 | Hatsumoto et al. | |
| 2006/0049204 | A1 | 3/2006 | Seelhofer et al. | |
| 2006/0071000 | A1 | 4/2006 | Weist et al. | |
| 2006/0163281 | A1 | 7/2006 | Weist | |
| 2007/0151993 | A1 | 7/2007 | Yelland | |
| 2007/0160792 | A1* | 7/2007 | Human | B29C 45/0055 428/36.9 |
| 2008/0105640 | A1 | 5/2008 | Ott | |
| 2008/0185384 | A1 | 8/2008 | Bolli | |
| 2009/0236304 | A1 | 9/2009 | Watson | |
| 2009/0302037 | A1 | 12/2009 | Rigling | |
| 2010/0237073 | A1 | 9/2010 | Alther et al. | |
| 2010/0326948 | A1 | 12/2010 | Campbell | |
| 2011/0000871 | A1 | 1/2011 | Bernard et al. | |
| 2011/0114593 | A1 | 5/2011 | Ishii et al. | |
| 2011/0174760 | A1 | 7/2011 | Luzzato et al. | |
| 2012/0024815 | A1 | 2/2012 | Kwon | |
| 2012/0298666 | A1 | 11/2012 | Kwon | |
| 2013/0001184 | A1 | 1/2013 | Groubert | |
| 2013/0001185 | A1 | 1/2013 | Antier et al. | |
| 2013/0097973 | A1* | 4/2013 | McCoy | B65D 25/205 215/200 |
| 2015/0144630 | A1 | 5/2015 | Backes et al. | |
| 2015/0259109 | A1 | 9/2015 | Vetten et al. | |
| 2015/0266631 | A1* | 9/2015 | Wohlgenannt | B65D 43/0281 215/44 |
| 2016/0207681 | A1* | 7/2016 | Deshpande | B65D 73/0014 |
| 2018/0118423 | A1 | 5/2018 | Bois et al. | |
| 2018/0170626 | A1* | 6/2018 | Kwon | B65D 41/3404 |
| 2018/0186505 | A1 | 7/2018 | Peterges et al. | |
| 2018/0370701 | A1 | 12/2018 | Maguire | |
| 2019/0106246 | A1 | 4/2019 | Kendall | |
| 2019/0344933 | A1 | 11/2019 | Kim | |
| 2019/0344944 | A1 | 11/2019 | Maguire | |
| 2019/0375555 | A1 | 12/2019 | Edie et al. | |
| 2020/0017260 | A1 | 1/2020 | Migas et al. | |
| 2020/0115115 | A1 | 4/2020 | Migas et al. | |
| 2020/0207525 | A1 | 7/2020 | Sung | |
| 2020/0369446 | A1 | 11/2020 | Melan-Moutet | |
| 2020/0377259 | A1 | 12/2020 | Reisert et al. | |
| 2020/0407124 | A1 | 12/2020 | Caszatt et al. | |
| 2021/0039838 | A1 | 2/2021 | Hanan | |
| 2021/0094733 | A1 | 4/2021 | Bloom et al. | |
| 2021/0094736 | A1 | 4/2021 | Maguire | |
| 2021/0179324 | A1 | 6/2021 | Hanan | |
| 2021/0188488 | A1 | 6/2021 | Dreyer et al. | |
| 2022/0002021 | A1* | 1/2022 | Krautkramer | B65D 55/16 |

FOREIGN PATENT DOCUMENTS

| | | | |
|---|---|---|---|
| CN | 1830730 | 9/2006 | |
| CN | 201209040 | 3/2009 | |
| CN | 102700823 | 10/2012 | |
| CN | 113015683 | 6/2021 | |
| DE | 9318243 | 2/1994 | |
| DE | 4123732 | 8/1998 | |
| DE | 102009010681 | 1/2010 | |
| DE | 202019106993 | 1/2020 | |
| DE | 202019106992 | 2/2020 | |
| DE | 102018128886 | 7/2020 | |
| DE | 102018130541 | 7/2020 | |
| DE | 102019132541 | 11/2020 | |
| DE | 102020107184 | 5/2021 | |
| DE | 102019132538 | 6/2021 | |
| DE | 202021103289 | 8/2021 | |
| EP | 1529736 | 5/2005 | |
| EP | 1961669 | 8/2008 | |
| EP | 3081505 | 10/2016 | |
| EP | 3135600 | 3/2017 | |
| EP | 3336003 | 6/2018 | |
| EP | 3584190 | 12/2019 | |
| EP | 3715275 | 9/2020 | |
| EP | 3715276 | 9/2020 | |
| EP | 3766797 | 1/2021 | |
| EP | 3798150 | 3/2021 | |
| EP | 3831736 | 6/2021 | |
| ES | 1266291 | 4/2021 | |
| FR | 2953202 | 6/2011 | |
| FR | 3084881 | 2/2020 | |
| FR | 3093709 | 9/2020 | |
| JP | 11-500091 | 1/1999 | |
| JP | 2001019002 | 1/2001 | |
| JP | 2004307006 | 11/2004 | |
| JP | 2005041566 | 2/2005 | |
| JP | 2005289488 | 10/2005 | |
| JP | 4906441 | 3/2008 | |
| JP | 2011-201559 | 10/2011 | |
| JP | 2014-061929 | 4/2014 | |
| JP | 5520768 | 6/2014 | |
| JP | 5574582 | 8/2014 | |
| JP | 5600461 | 10/2014 | |
| KR | 20-0213792 | 2/2001 | |
| KR | 10-0855086 | 8/2008 | |
| KR | 20080093839 | 10/2008 | |
| KR | 10-0872159 | 1/2009 | |
| KR | 10-0942642 | 2/2010 | |
| KR | 10-0981240 | 9/2010 | |
| KR | 1017448460000 | 6/2017 | |
| MX | 2007015318 | 2/2008 | |
| WO | WO2002/062674 | 8/2002 | |
| WO | WO-2004035394 A1 * | 4/2004 | B65D 1/0246 |
| WO | WO2005/073098 | 8/2005 | |
| WO | WO2008/142413 | 11/2008 | |
| WO | WO2009/048273 | 4/2009 | |
| WO | WO2015/061834 | 5/2015 | |
| WO | WO2016/160591 | 10/2016 | |
| WO | WO2019/031779 | 2/2019 | |
| WO | WO2019/175740 | 9/2019 | |
| WO | WO2019/177616 | 9/2019 | |
| WO | WO2020/041640 | 2/2020 | |
| WO | WO2020/050823 | 3/2020 | |
| WO | WO2020/077162 | 4/2020 | |
| WO | WO2020/093058 | 5/2020 | |
| WO | WO2020/099516 | 5/2020 | |
| WO | WO2020/156847 | 8/2020 | |

(56) References Cited

FOREIGN PATENT DOCUMENTS

| | | |
|---|---|---|
| WO | WO2020/157695 | 8/2020 |
| WO | WO2020/182854 | 9/2020 |
| WO | WO2020/201227 | 10/2020 |
| WO | WO2020/212426 | 10/2020 |
| WO | WO2020/227813 | 11/2020 |
| WO | WO2021/005428 | 1/2021 |
| WO | WO2021/005505 | 1/2021 |
| WO | WO2021/013370 | 1/2021 |
| WO | WO2021/014287 | 1/2021 |
| WO | WO2021/018740 | 2/2021 |
| WO | WO2021/018772 | 2/2021 |
| WO | WO2021/018775 | 2/2021 |
| WO | WO2021/019419 | 2/2021 |
| WO | WO2021/021095 | 2/2021 |
| WO | WO2021/053488 | 3/2021 |
| WO | WO2021/067412 | 4/2021 |
| WO | WO2021/068058 | 4/2021 |
| WO | WO2021/074726 | 4/2021 |
| WO | WO2021/074727 | 4/2021 |
| WO | WO2021/074728 | 4/2021 |
| WO | WO2021/080550 | 4/2021 |
| WO | WO2021/099323 | 5/2021 |
| WO | WO2021/099358 | 5/2021 |
| WO | WO-2021084028 A1 * | 5/2021 ..... B65D 1/0246 |

OTHER PUBLICATIONS

International Search Report and Written Opinion for International Application No. PCT/US2020/049493, dated Dec. 17, 2020, 13 pages.

International Search Report and Written Opinion for International Application No. PCT/US2020/049459, dated Dec. 8, 2020, 13 pages.

International Search Report and Written Opinion for International Application No. PCT/US2020/049453, dated Dec. 14, 2020, 13 pages.

* cited by examiner

PROTRUSION ON CONTAINER NECK

CROSS-REFERENCE TO RELATED PATENT APPLICATIONS

The present application is a continuation of International Application No. PCT/US2022/079390, filed Nov. 7, 2022, which claims the benefit of and priority to U.S. Provisional Application No. 63/292,266, filed Dec. 21, 2021, and U.S. Provisional Application No. 63/276,991, filed Nov. 8, 2021, each of which is incorporated herein by reference in its entirety.

BACKGROUND OF THE INVENTION

The present disclosure is directed generally to container. The present disclosure relates specifically to container for liquids that include hinged, tethered closures.

SUMMARY OF THE INVENTION

One embodiment of the invention relates to a container including a body defining a storage compartment, a container neck coupled to the body, the container neck extending along a longitudinal axis between the body and an opening, a thread extending helically outward from the container neck, the thread configured to detachably engage with a closure affixed to the container neck, the closure configured to actuate between a closed configuration in which the closure encloses the opening and an open configuration in which a tab of the closure interfaces with the container neck to bias a body of the closure away from the container neck, an A-bead extending radially away from the container neck, the A-bead configured to engage with a retention band of the closure to bias the retention band to remain coupled to the container neck after the closure has been opened, and a protrusion extending upward from the A-bead. The protrusion is configured to engage the tab of the closure to bias the body of the closure away from the container neck.

Another embodiment of the invention relates to a container including a body, a container neck coupled to the body, the container neck extending along a longitudinal axis between the body and an opening, a thread extending helically outward from the container neck, an outermost portion of the thread defining a T-diameter that is a maximum diameter of the thread with respect to the axis, the thread configured to detachably engage with a closure affixed to the container neck, the closure configured to actuate between a closed configuration in which the closure encloses the opening and an open configuration in which a tab of the closure interfaces with the container neck to bias a body of the closure away from the container neck, an A-bead extending radially away from the container neck, the A-bead configured to engage with a retention band of the closure to bias the retention band to remain coupled to the container neck after the closure has been opened, and a protrusion extending upward from the A-bead. The protrusion defines an outer surface defining a second diameter that is a maximum diameter of the protrusion with respect to the axis, and the second diameter is less than or equal to the T-diameter.

Another embodiment of the invention relates to a container including a body, a container neck coupled to the body, the container neck extending along a longitudinal axis between the body and an opening, a thread extending helically outward from the container neck, the thread configured to detachably engage with a closure affixed to the container neck, the closure configured to actuate between a closed configuration in which the closure encloses the opening and an open configuration in which a tab of the closure interfaces with the container neck to bias a body of the closure away from the container neck, an A-bead extending radially away from the container neck, the a-bead configured to engage with a retention band of the closure to bias the retention band to remain coupled to the container neck after the closure has been opened, the A-bead defining an outer surface defining a first diameter that is a maximum diameter of the A-bead with respect to the axis, and a protrusion extending upward from the a-bead. The protrusion defines an outer surface facing away from the axis, the outer surface defines a second diameter that is a maximum diameter of the protrusion from the axis, and the second diameter is less than the first diameter.

Another embodiment of the invention relates to a container neck of a container. The container includes an A-ring that interfaces with the tab of a hinged, tethered closure when the closure is in the open configuration. In particular, a protrusion, such as a triangular bump, extends from the A-ring and interfaces with the hinged, tethered closure when the closure is in the open configuration. As a result, the body of the closure is displaced further from the container neck opening than without the protrusion on the A-ring.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a container neck are shown. The container neck includes a protrusion configured to engage with the tab of a hinged, tethered closure. In use, the protrusion biases the body of the closure further from the container neck opening than if the protrusion was not present. As shown, the A-bead biases the tab of the closure further upward and away from the longitudinal axis of the container neck. As a result, when a protrusion is coupled to A-bead and extending upward, the body of the closure is biased further from the container neck than if the protrusion was not present.

Figure 1:
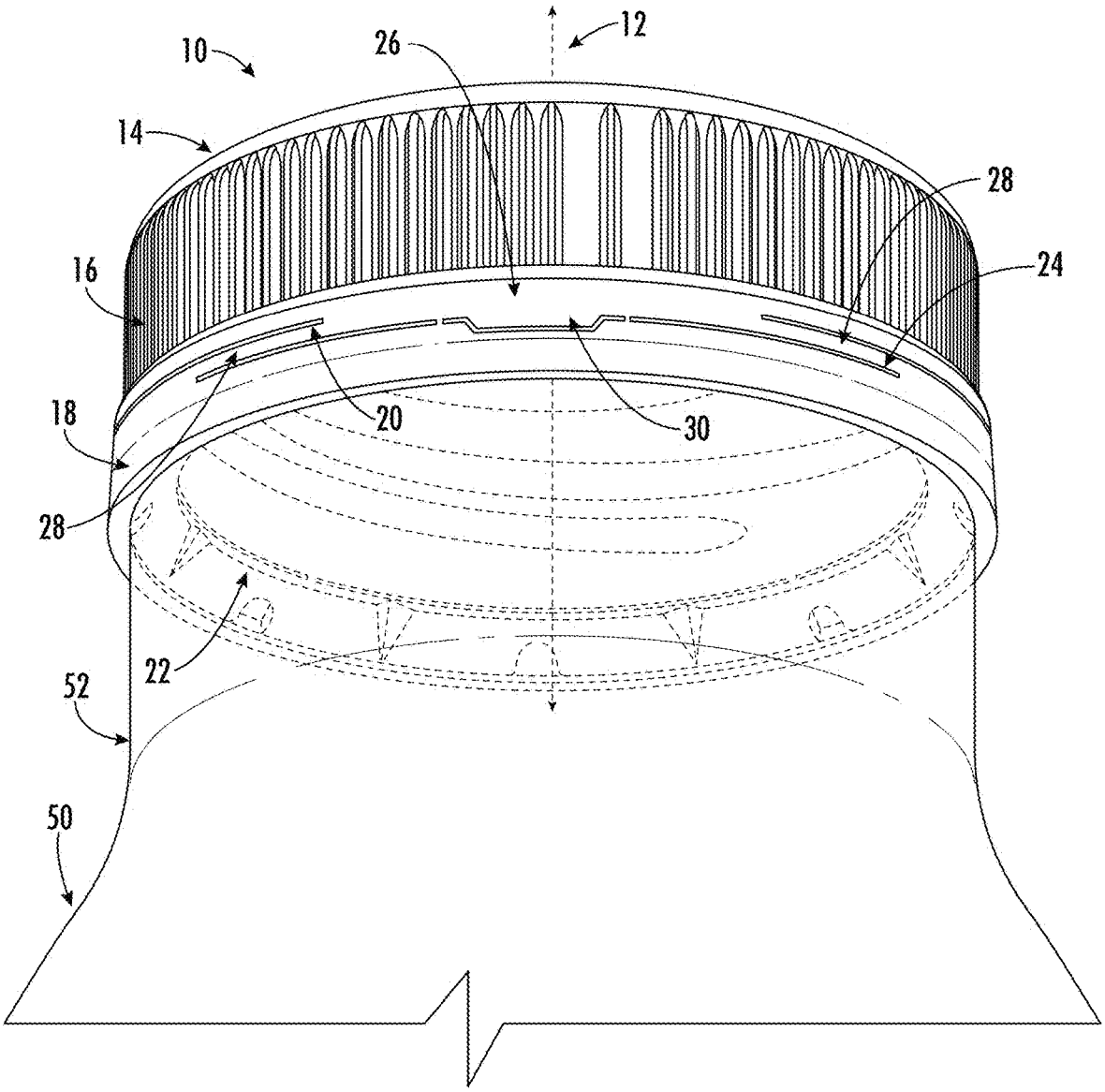
FIG. 1 is a perspective view of a closure coupled to container including a protrusion on the A-bead, according to an exemplary embodiment.
Figure 2:
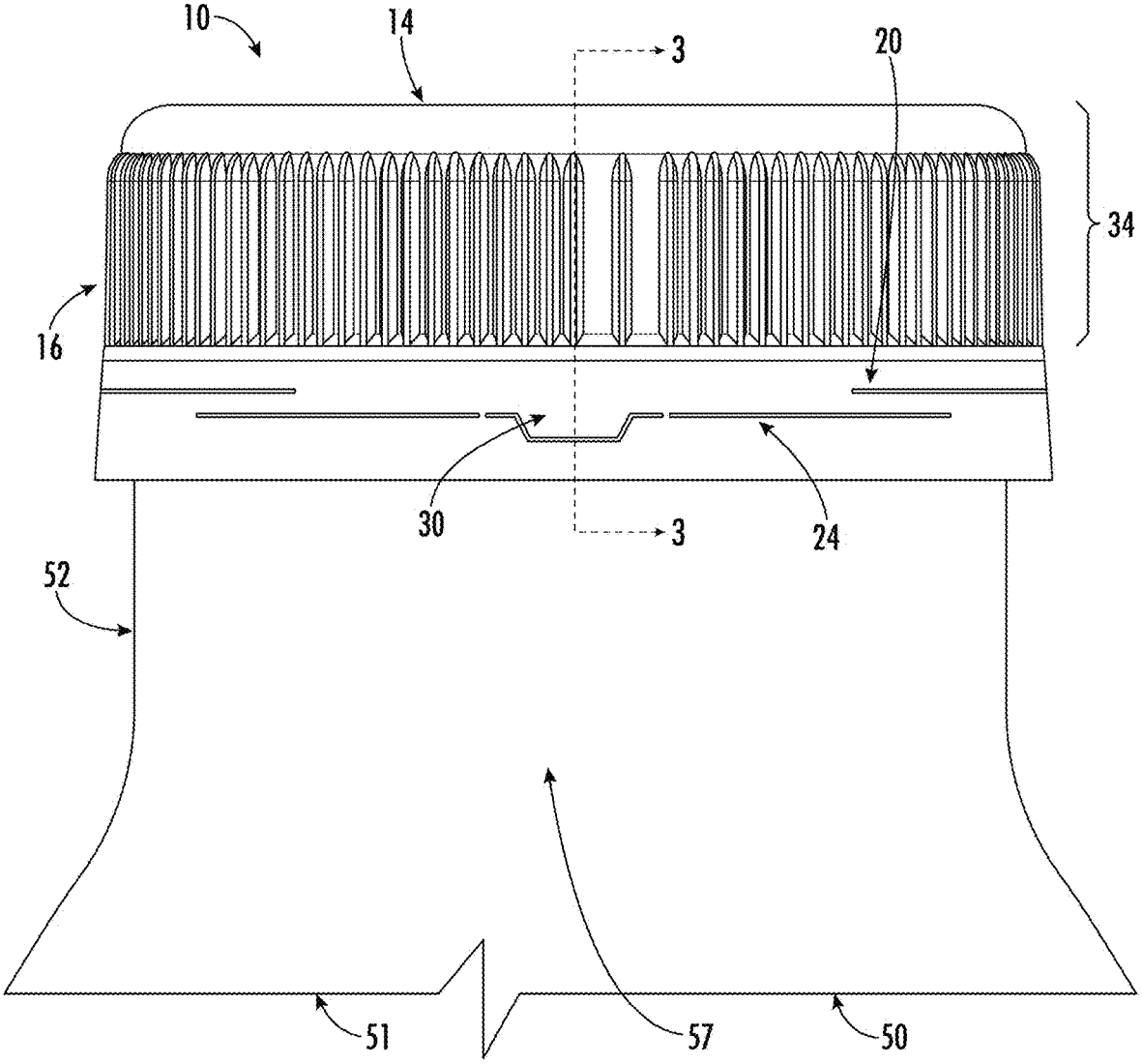
FIG. 2 is a front view of a closure coupled to container including a protrusion on the A-bead, according to an exemplary embodiment.

Referring to FIGS. 1-2, a closure 10 is shown affixed to a container 50, such as by being coupled to container 50 via helical threads. Closure 10 includes a top panel 14, a skirt 16 extending downward from the top panel, the skirt 16 centered on axis 12.

Body 34 of closure 10 includes top panel 14 and skirt 16, which is coupled to retention band 18 via various structures. Skirt 16 is initially coupled to retention band 18 via one or more plurality of frangible connections extending across primary slit 20. Closure 10 also includes one or more tethers 28 that couple body 34 to retention band 18 after closure 10 has been opened. As shown, closure 10 includes two tethers 28. Tethers 28 extend circumferentially around closure 10 between primary slit 20 and secondary slit 24. In various embodiments, primary slit 20 and secondary slit 24 are mechanically slit via a blade and/or are formed when the closure 10 is formed (e.g., slits 20, 24 are molded into the closure). In various alternative embodiments, primary slit 20 and/or secondary slit 24 form different configurations for the tethers 28 and tab 30 (e.g., secondary slit 24 forms multiple tabs that interface against the container neck).

As will be understood, the frangible connections break the first time that closure 10 is opened from container 50, thereby evidencing the fact that closure 10 has been opened. In particular, J-band 22 of closure 10 interfaces with a portion of container 50, such as A-bead 60, thereby biasing the retention band 18 downward as body is biased upward by the user twisting closure 10 into the open position. In various embodiments, retention band 18 interfaces against the container neck (e.g., A-bead 60) via structures other than a J-band.

After closure 10 is opened, body 34 is pivoted away from the opening of the container 50. In various embodiments, body 34 pivots with respect container 50 at or near a rotational axis at hinge 26. As will be shown, when body 34 is pivoted into the open position, tab 30 interfaces with the neck of container 50 to bias body 34 away from the opening of the container 50. In particular, closure 10 is configured to actuate between a closed configuration in which the closure 10 encloses the opening of container 50 and an open configuration in which a tab 30 of the closure 10 interfaces with the container neck 52 to bias a body 34 of the closure 10 away from the container neck 52.

Figure 3:
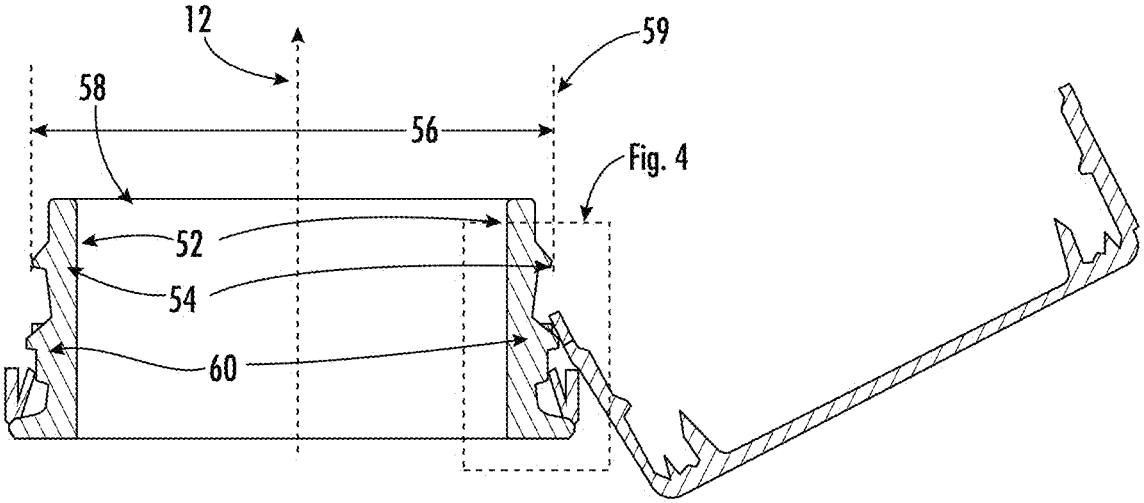
FIG. 3 is a cross-section view of the closure and container of FIG. 1 taken along the line 3-3 in FIG. 2, according to an exemplary embodiment.
Figure 4:
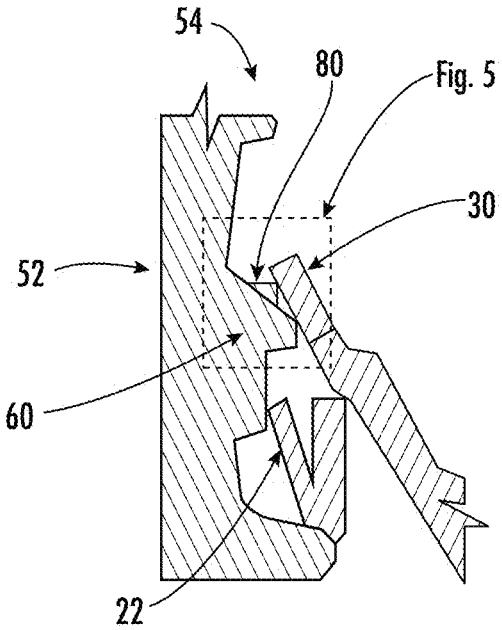
FIG. 4 is a detailed cross-section view of the closure and container of FIG. 1 taken along the line 3-3 in FIG. 2, according to an exemplary embodiment.
Figure 5:
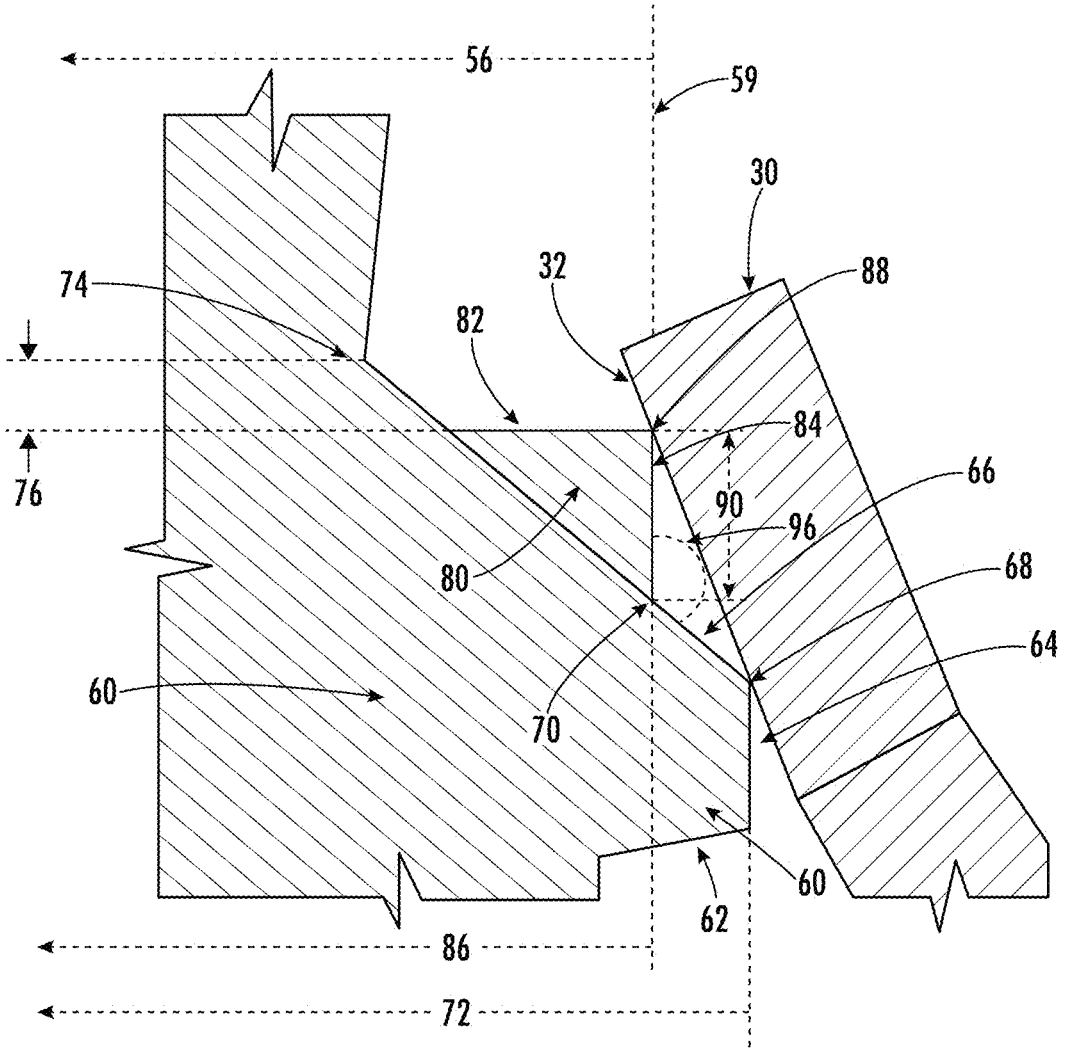
FIG. 5 is a detailed cross-section view of the closure and container of FIG. 1 taken along the line 3-3 in FIG. 2, according to an exemplary embodiment.

Referring to FIGS. 3-5, various aspects of protrusion 80 on A-bead 60 of container 50 are shown. Container 50 includes a body 51 defining a storage compartment 57 configured to store contents within the container 50. Container neck 52 extends upward from body 51, between body 51 and opening 58 of container 50. In various embodiments, container neck 52 is centered around and/or extends along longitudinal axis 12. In various embodiments, container neck 52 includes a helical thread 54 configured to couple container 50 to closure 10. In various embodiments, container neck 52 is coupled to the body 51, the container neck 52 extending along a longitudinal axis 12 between the body 51 and an opening 58. Thread 54 extends helically outward from the container neck 52, the thread 54 being configured to detachably engage with closure 10 affixed to the container neck 52. Closure 10 and/or container 50 are configured to, in combination with each other, actuate between a closed configuration in which closure 10 encloses the opening 58 and an open configuration in which a tab 30 of the closure 10 interfaces with the container neck 52 to bias a body 34 of the closure 10 away from the container neck 52. In various embodiments, helical thread 54 defines a T-diameter 56 that is a maximum diameter of the thread 54 with respect to the axis 12, and T-diameter 56 defines imaginary cylinder 59 that extends around axis 12 at T-diameter 56 from axis 12.

A protrusion, shown as A-bead 60, extends from container neck 52. In various embodiments, A-bead 60 extends circumferentially around container neck 52. A-bead 60 is configured to interface with closure 10, such as being configured to interface with J-band 22 of closure 10 when closure 10 is being opened for the first time. Stated another way, the A-bead 60 is configured to engage with a retention band 18 of the closure 10 to bias the retention band 18 to remain coupled to the container neck 52 after the closure 10 has been opened. In various embodiments, protrusion 80 and A-bead 60 are molded contemporaneously (e.g., when closure 10 is initially formed, such as by being integrally molded). In various embodiments, protrusion 80 is affixed to A-bead 60 via an adhesive.

Referring to FIG. 5, various aspects of A-bead 60 are shown. A-bead 60 extends radially away from the container neck 52. A-bead 60 is configured to engage with a retention band 18 of the closure 10 to bias the retention band 18 to remain on (e.g., coupled to) the container neck 52 after the closure 10 has been opened. A-bead 60 includes lower surface 62, outer surface 64, and upper surface 66. Lower surface 62 faces downward or mostly downward, outer surface 64 faces away from axis 12, and upper surface 66 faces upward and/or away from lower surface 62. In various embodiments, outer surface 64 and upper surface 66 intersect at corner 68. Outer surface 64 defines diameter 72 that is a maximum diameter of the A-bead 60 with respect to the axis 12.

An elevated surface, shown as protrusion 80, extends from and is coupled to A-bead 60. In various embodiments, protrusion 80 extends upward from A-bead 60. Protrusion 80 is configured to engage the tab 30 of the closure 10 to bias the body 34 of the closure 10 away from the container neck 52. Protrusion 80 defines an upper surface 82 and an outer surface 84, which intersect at an intersecting location, shown as corner 88. In various embodiments, outer surface 84 faces away from axis 12 and defines diameter 86 that is a maximum diameter of the protrusion 80 from the axis 12. In various embodiments, upper surface 82 faces upward, such as parallel to axis 12. In various aspects, inner surface 32 of tab 30 of closure 10 is configured to interface against protrusion 80, thereby biasing body 34 away from opening 58 of container 50.

In various embodiments, tab 30 of closure 10 is configured to interface with the corner 88 when the protrusion 80 is biasing the body 34 of the closure 10 away from the container neck 52. In various embodiments, tab 30 of the closure 10 does interface with the A-bead 60 at corner 68 when the tab 30 of the closure 10 is interfacing with corner 88. In various embodiments, the tab 30 of the closure 10 defines an inner surface 32 that faces away from the axis 12 when the closure 10 is in the closed configuration, and the inner surface 32 of the tab 30 interfaces with the corner 88 of the protrusion 80 when the closure 10 is in the open closed configuration (e.g., FIG. 3).

Alternatively, in various embodiments tab 30 of the closure 10 does not interface with A-bead 60 when tab 30 is interfacing with protrusion 80.

In various embodiments, A-bead 60 defines an upper surface 66 that faces upward, and the upper surface 66 of the A-bead 60 extends between the protrusion 80 and the container neck 52 (e.g., upper surface 66 intersects with each of protrusion 80 and container neck 52). In various embodiments, A-bead 60 defines an upper surface 66 that faces upward and an outer surface 64 that extends away from the longitudinal axis 12, and the upper surface 66 of the A-bead 60 extends between the protrusion 80 and the outer surface 64 of the A-bead 60 (e.g., upper surface 66 intersects with each of protrusion 80 and outer surface 64).

In various embodiments, A-bead 60 defines an upper surface 66 that extends from a top 74 of the A-bead 60 to the protrusion 80, and the protrusion 80 defines an upper surface 82 that faces upward and an outer surface 84 that faces away from the axis 12, the outer surface 84 of the protrusion 80 and the upper surface 82 of the protrusion 80 intersecting at a corner 88 that is below the top 74 of the A-bead 60. In various embodiments, the outer surface 84 of the protrusion 80 extends a first height 90 from the A-bead 60, the top 74 of the A-bead 60 is a second height 76 above the corner 88 of the protrusion 80, and the second height 76 is less than the first height 90.

Outer surface 84 of protrusion 80 interfaces with A-bead 60 at intersection, shown as corner 70. Outer surface 84 defines a diameter 86 that is a maximum diameter of the protrusion 80 with respect to the axis 12. Outer surface 84 extends height 90 between corner 70 and corner 88.

In various embodiments, outer surface 84 of protrusion 80 is aligned with cylinder 59 of T-diameter 56 of thread 54 and/or outer surface 84 of protrusion 80 is closer to axis 12 than cylinder 59. Stated another way, T-diameter 56 is greater than or equal to diameter 86 of protrusion 80. In various embodiments, diameter 86 of protrusion 80 is less or equal to than T-diameter 56, and more specifically diameter 86 is less than T-diameter 56.

In various embodiments, outer surface 64 of A-bead 60 is further from axis 12 than outer surface 84 of protrusion 80. In various embodiments, diameter 72 of outer surface 64 of A-bead 60 is greater than diameter 86 of outer surface 84 of protrusion 80. Stated another way, diameter 86 of outer surface 84 is less than diameter 72 of outer surface 64 of A-bead 60.

In various embodiments, protrusion 80 is inside the T-wall (e.g., inside cylinder 59), which is the major diameter of the threads 54 (e.g., T-diameter 56) extending from the container neck 52. Applicant has observed that having protrusion 80 slightly recessed such that the protrusion 80 is within the T-wall permits the tab of the closure to more easily pivot past protrusion 80 compared to if protrusion 80 extends from the outermost portion of the A-bead 60.

In various embodiments protrusion 80 is adhered to the A-bead 60, such as by being glued. In another embodiment, protrusion 80 is molded to the A-bead 60 when the container neck is formed and/or manufactured.

In various embodiments, outer surface 84 of protrusion 80 defines angle 96 with respect to upper surface 66 of A-bead 60. In various embodiments, angle 96 is between 115 and 165 degrees, and more specifically between 120 and 150 degrees, and more specifically between 125 and 145 degrees, and more specifically between 130 and 140 degrees, and more specifically 135 degrees. In various embodiments, angle 96 is at least 120 degrees, and more particularly is at least 135 degrees, and more particularly is at least 140 degrees, and more particularly is at least 145 degrees.

Figure 6:
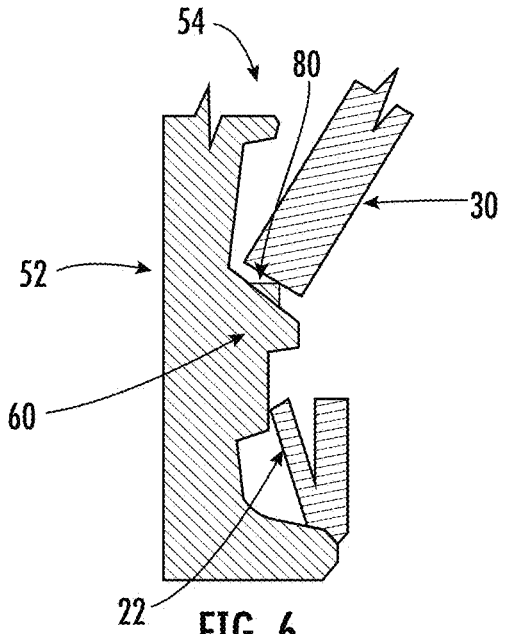
FIG. 6 is a detailed cross-section view of the closure and container of FIG. 1 taken along the line 3-3 in FIG. 2, according to an exemplary embodiment.

Referring to FIG. 6, protrusion 80 also facilitates reapplying the closure (e.g., closure 10) to the container (e.g., container 50). For example, sidewalls of closure 10 rest on protrusion 80, thereby helping the user align the threading of the closure and the threading of the container when the user is applying the closure back on top of the container.

Figure 7:
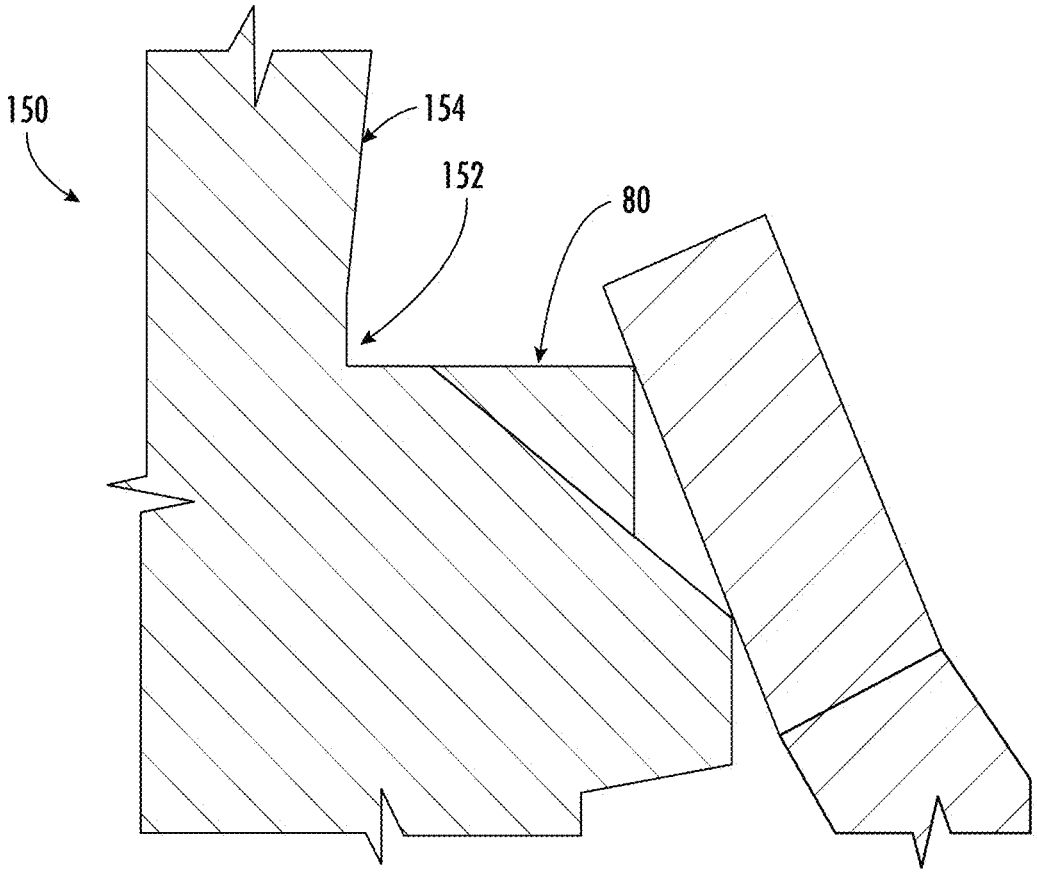
FIG. 7 is a detailed cross-section view of the closure of FIG. 1 taken along the line 3-3 in FIG. 2 and a second container, according to an exemplary embodiment.

Referring to FIG. 7, various aspects of container 150 are shown. Container 150 is substantially the same as container 50 except for the differences as described herein. In particular, container 150 includes a recess 152 between protrusion 80 and outer surface 154 of container 150. This is in contrast to container 50, in which A-bead 60 extends linearly from protrusion 80 to the outer surface of container 50.

Figure 8:
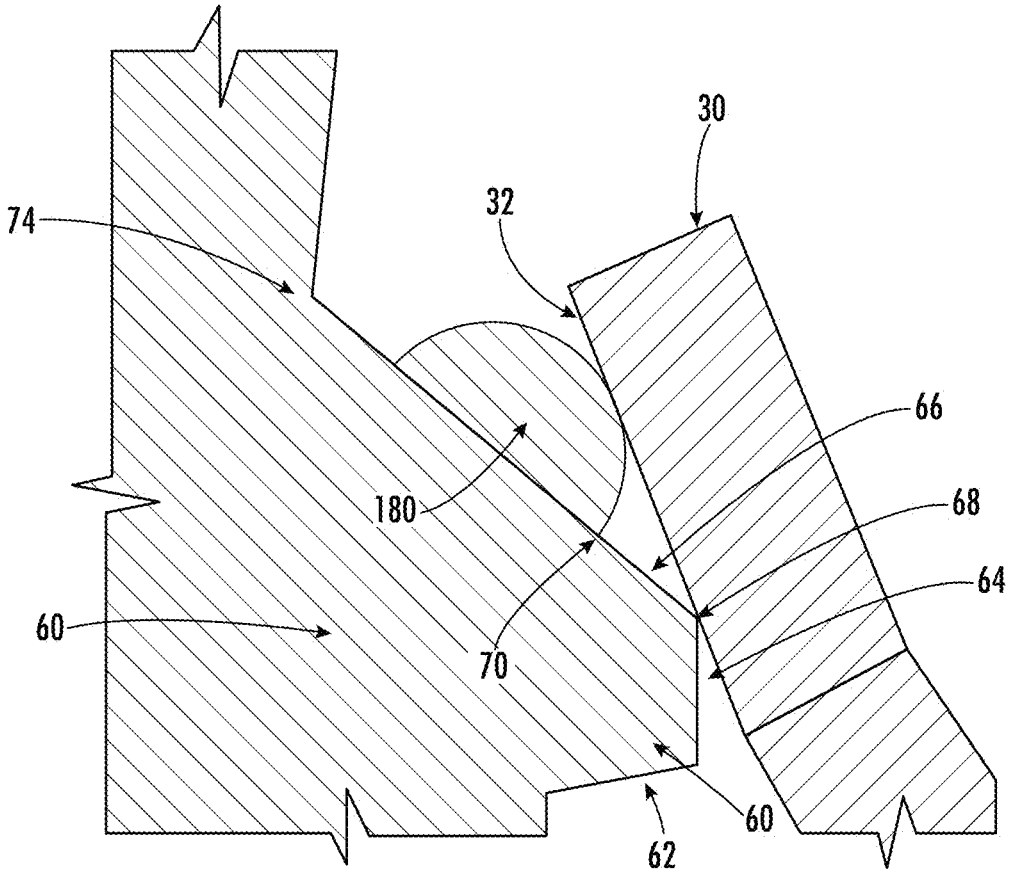
FIG. 8 is a detailed cross-section view of the closure of FIG. 1 taken along the line 3-3 in FIG. 2 and a third container, according to an exemplary embodiment.

Referring to FIG. 8, various aspects of protrusion 180 are shown. Protrusion 180 is substantially the same as protrusion 80 except for the differences described herein. In particular, protrusion 180 includes one or more curved outer surfaces. In a specific embodiment, protrusion 180 defines a portion of the outer surface of a circle, such as a semi-circle.

Figure 9:
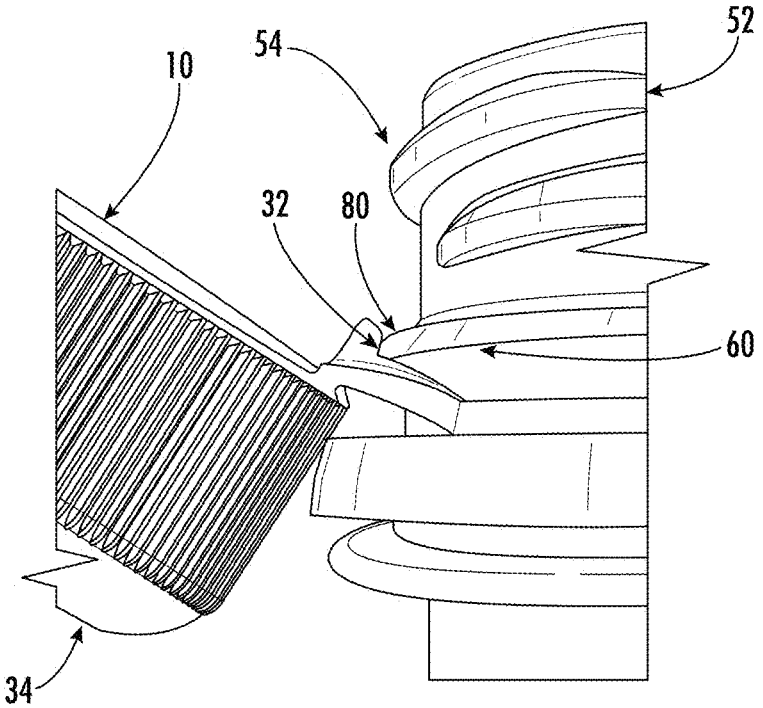
FIG. 9 is a side view of the container of FIG. 1, according to an exemplary embodiment.
Figure 10:
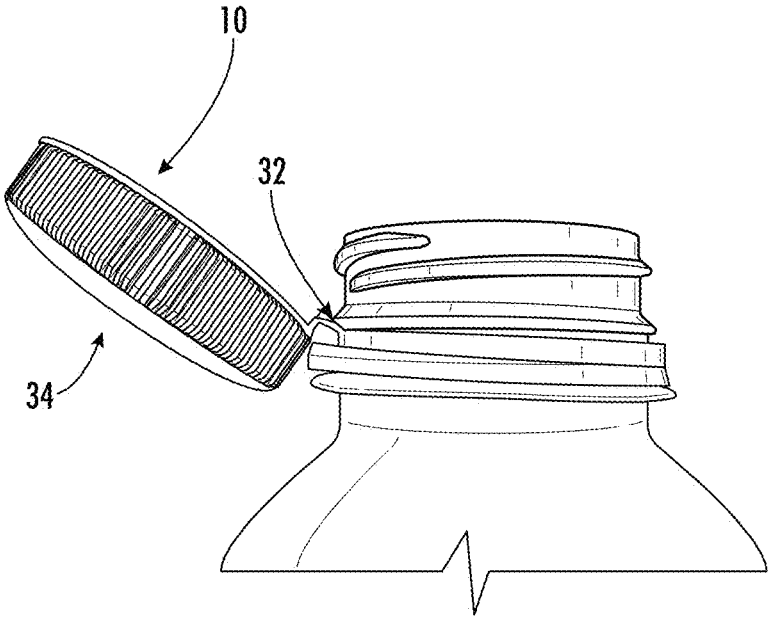
FIG. 10 is a side view of the container of FIG. 1, according to an exemplary embodiment.

Referring to FIG. 9, in various embodiments protrusion 80 extends circumferentially around the entire container (e.g., container 50), as shown.

Figure 11:
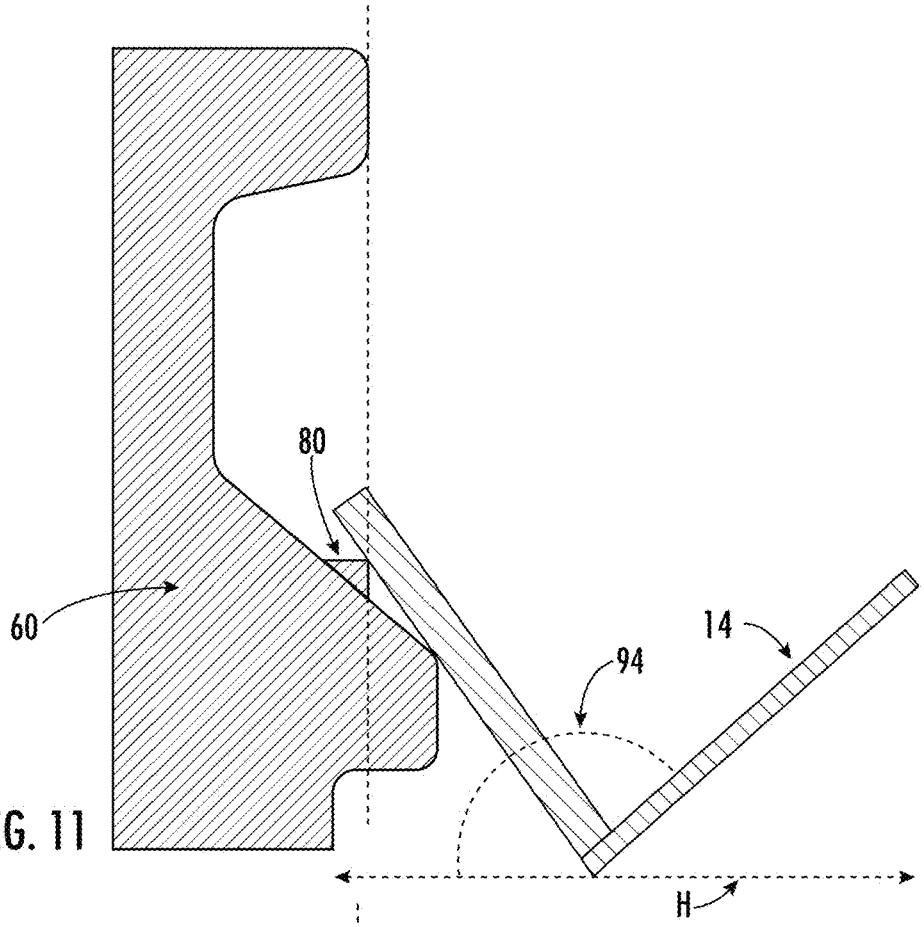
FIG. 11 is a cross-section view of the closure and container of FIG. 1 taken along the line 3-3 in FIG. 2, according to an exemplary embodiment.

Referring to FIG. 11, top panel 14 of closure 10 defines angle 94 with respect to horizontal when body 34 of closure 10 is in the open position. In particular, the interface between tab 30 of closure 10 and protrusion 80 of container 50 biases body 34 of closure 10 to define angle 94 with respect to a horizontal plane, shown as H.

In various embodiments, angle 94 is between 135 and 165 degrees, and more specifically between 140 and 160 degrees, and more specifically between 145 and 155 degrees, and more specifically 150 degrees. In various embodiments, angle 94 is at least 135 degrees, and more particularly is at least 140 degrees, and more particularly is at least 145 degrees, and more particularly is at least 150 degrees.

Figure 12:
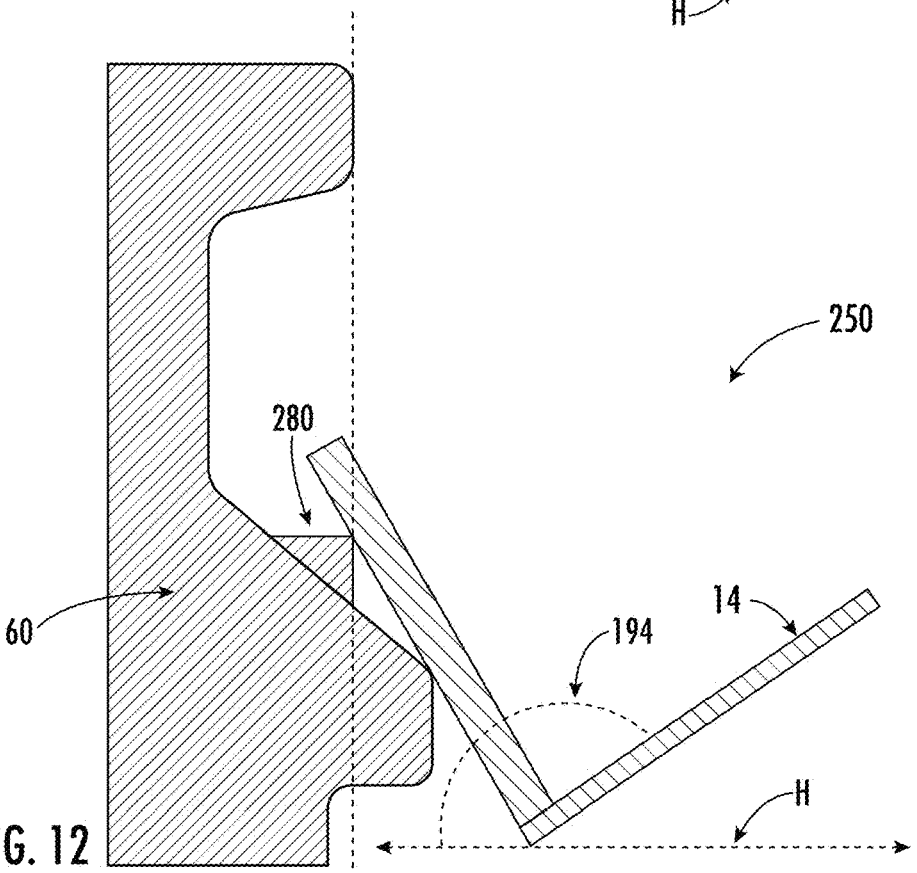
FIG. 12 is a cross-section view of a closure and a container including a protrusion on the A-bead, according to an exemplary embodiment.

Referring to FIG. 12, container 250 includes protrusion 280. Protrusion 280 is substantially the same as protrusion 80 or protrusion 180 except for the differences discussed herein. In particular, protrusion 280 is larger than protrusion 80. As a result, protrusion 280 biases body 34 of closure 10 to define angle 194 with respect to horizontal plane H, which is greater than angle 94.

In various embodiments, angle 194 is between 150 and 180 degrees, and more specifically between 155 and 175 degrees, and more specifically between 160 and 170 degrees, and more specifically 165 degrees. In various embodiments, angle 194 is at least 150 degrees, and more particularly is at least 155 degrees, and more particularly is at least 160 degrees, and more particularly is at least 165 degrees.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container comprising:

a body defining a storage compartment;

a container neck coupled to the body, the container neck extending along a longitudinal axis between the body and an opening;

a thread extending helically outward from the container neck, the thread configured to detachably engage with a closure affixed to the container neck, wherein the closure is distinct from the container, the closure configured to actuate between a closed configuration in which the closure encloses the opening and an open configuration in which a tab of the closure interfaces with the container neck to bias a body of the closure away from the container neck;

an A-bead extending radially away from the container neck, the A-bead configured to engage with a retention band of the closure to bias the retention band to remain coupled to the container neck after the closure has been opened; and a protrusion extending upward from the A-bead, the protrusion configured to engage the tab of the closure to bias the body of the closure away from the container neck, wherein the A-bead defines an upper surface that extends from a top of the A-bead to the protrusion, and wherein the protrusion defines an upper surface that faces upward and an outer surface that faces away from the axis, the outer surface of the protrusion and the upper surface of the protrusion intersecting at a corner, the corner being below the top of the A-bead.

2. The container of claim 1, wherein the outer surface of the protrusion defines a first angle with the upper surface of the A-bead, and wherein the first angle is between 120 degrees and 150 degrees.

3. The container of claim 1, wherein the tab of the closure is configured to interface with the corner when the protrusion is biasing the body of the closure away from the container neck.

4. The container of claim 1, wherein:

the thread defines a first diameter that is a maximum diameter of the thread with respect to the axis; and the outer surface of the protrusion defining a second diameter that is less than or equal to the first diameter.

5. The container of claim 4, wherein the second diameter is less than the first diameter.

6. The container of claim 1, wherein the protrusion is affixed to the A-bead via an adhesive.

7. The container of claim 1, wherein the protrusion and the A-bead are molded contemporaneously.

8. The container of claim 1, the upper surface of the A-bead extends between the protrusion and the container neck.

9. The container of claim 1, wherein the A-bead defines an outer surface that extends away from the longitudinal axis, and wherein the upper surface of the A-bead extends between the protrusion and the outer surface of the A-bead.

10. The container of claim 1, the outer surface of the protrusion extending a first height from the A-bead, wherein the top of the A-bead is a second height above the corner of the protrusion, and wherein the second height is less than the first height.

11. A container comprising:

a body;

a container neck coupled to the body, the container neck extending along a longitudinal axis between the body and an opening;

a thread extending helically outward from the container neck, an outermost portion of the thread defining a T-diameter that is a maximum diameter of the thread with respect to the axis, the thread configured to detachably engage with a closure affixed to the container neck, wherein the closure is distinct from the container, the closure configured to actuate between a closed configuration in which the closure encloses the opening and an open configuration in which a tab of the closure interfaces with the container neck to bias a body of the closure away from the container neck;

an A-bead extending radially away from the container neck, the A-bead configured to engage with a retention band of the closure to bias the retention band to remain coupled to the container neck after the closure has been opened; and a protrusion extending upward from the A-bead, the protrusion defining an outer surface defining a second diameter that is a maximum diameter of the protrusion with respect to the axis, wherein the second diameter is less than the T-diameter, wherein the A-bead defines an upper surface that faces upward, and wherein the upper surface of the A-bead extends between the protrusion and the container neck, and wherein the A-bead defines an outer surface that extends away from the longitudinal axis, and wherein the upper surface of the A-bead extends between the protrusion and the outer surface of the A-bead.

12. The container of claim 11, the protrusion defining an upper surface that faces upward and wherein the outer surface faces away from the axis, the outer surface of the protrusion and the upper surface of the protrusion intersecting at a corner, and wherein the tab of the closure is configured to interface with the corner when the protrusion is biasing the body of the closure away from the container neck.

13. A container comprising:

a body;

a container neck coupled to the body, the container neck extending along a longitudinal axis between the body and an opening;

a thread extending helically outward from the container neck, the thread configured to detachably engage with a closure affixed to the container neck, wherein the closure is distinct from the container, the closure configured to actuate between a closed configuration in which the closure encloses the opening and an open configuration in which a tab of the closure interfaces with the container neck to bias a body of the closure away from the container neck;

an A-bead extending radially away from the container neck, the A-bead configured to engage with a retention band of the closure to bias the retention band to remain coupled to the container neck after the closure has been opened, the A-bead defining an outer surface defining a first diameter that is a maximum diameter of the A-bead with respect to the axis; and a protrusion extending upward from the A-bead, the protrusion defining an outer surface facing away from the axis, the outer surface of the protrusion defining a second diameter that is a maximum diameter of the protrusion from the axis, wherein the second diameter is less than the first diameter, wherein the A-bead defines an upper surface that extends from a top of the A-bead to the protrusion, and wherein the protrusion defines an upper surface that faces upward, the outer surface of the protrusion and the upper surface of the protrusion intersecting at a corner, the corner being below the top of the A-bead.

14. The container of claim 13, wherein the outer surface of the protrusion defines a first angle with the upper surface of the A-bead, and wherein the first angle is between 120 degrees and 150 degrees.

15. The container of claim 13, wherein the tab of the closure is configured to interface with the corner when the protrusion is biasing the body of the closure away from the container neck.

* * * * *